US007143524B2

(12) United States Patent
Flaugher

(10) Patent No.: US 7,143,524 B2
(45) Date of Patent: Dec. 5, 2006

(54) DESICCANT CARTRIDGE HAVING DESICCANT CAP

(75) Inventor: David V. Flaugher, Beavercreek, OH (US)

(73) Assignee: Flow Dry Technology Ltd., Brookville, OH (US)

( * ) Notice: Subject to any disclaimer, the term of this patent is extended or adjusted under 35 U.S.C. 154(b) by 0 days.

(21) Appl. No.: 10/518,439

(22) PCT Filed: Jun. 4, 2003

(86) PCT No.: PCT/US03/17445

§ 371 (c)(1),
(2), (4) Date: Dec. 17, 2004

(87) PCT Pub. No.: WO04/001308

PCT Pub. Date: Dec. 31, 2003

(65) Prior Publication Data

US 2005/0252026 A1 Nov. 17, 2005

Related U.S. Application Data

(60) Provisional application No. 60/391,446, filed on Jun. 25, 2002.

(51) Int. Cl.
*F26B 19/00* (2006.01)

(52) U.S. Cl. ..... 34/85; 34/165; 34/242

(58) Field of Classification Search ..... 34/523, 34/DIG. 1, 60, 85, 90, 165, 242, 80; 62/271
See application file for complete search history.

(56) References Cited

U.S. PATENT DOCUMENTS 2,758,719 A * 8/1956 Line ..... 210/288
3,545,227 A * 12/1970 Grahl ..... 62/474
3,814,261 A * 6/1974 Morgan, Jr. ..... 210/453
3,879,292 A 4/1975 McClive
3,918,578 A 11/1975 Cullen et al.
4,436,623 A 3/1984 Cullen et al.
4,457,843 A 7/1984 Cullen et al.
5,038,582 A 8/1991 Takamatsu
5,983,516 A * 11/1999 Trapp et al. ..... 34/80
6,692,556 B1 * 2/2004 Hayes et al. ..... 96/147

* cited by examiner

*Primary Examiner*—S. Gravini
(74) *Attorney, Agent, or Firm*—Wegman, Hessler & Vanderburg

(57) ABSTRACT

This invention relates to a desiccant cartridge (10) adapted for use in a canister (14) of an integrated receiver/dryer or accumulator assembly of an automotive air conditioning system wherein the canister (14) has an offset inlet port (16). The desiccant cartridge (10) includes a desiccant cup (18) having a center tube (36) and a desiccant cap (12) including a planar portion (44) having a recessed port area (46) provided with a first aperture (56), or first tube (72), for cooperation with a side tube (78) and/or the offset inlet port (16) of the canister (14). The cap (12) further includes a docking piece (80) provided with a second aperture (88), or second tube (92), for cooperating with the center tube (36) of the cup (18) when the cap (12) is retained therein. Notably, the docking piece (80) is designed to cooperate with the recessed port area (46), preferably via a snap fit, to define a passageway (98) therebetween so that gas and/or fluid can enter the canister (14) via the inlet port (16), circulate through the desiccant cartridge (10), and finally exit via an outlet port (126).

17 Claims, 6 Drawing Sheets

DESICCANT CARTRIDGE HAVING DESICCANT CAP

CROSS-REFERENCE TO RELATED APPLICATIONS

This application claims the priority filing benefit of International PCT application PCT/US2003/017445 filed Jun. 4, 2003, and published under PCT 21(2) in the English language; U.S. Provisional Patent Application Ser. No. 60/391,446 filed Jun. 25, 2002.

FIELD OF THE INVENTION

This invention relates generally to desiccant cartridges for use in automotive air conditioning systems. More specifically, it relates to a desiccant cartridge having a desiccant cap adapted for use in a canister of an integrated receiver/dryer or accumulator assembly wherein the canister has an offset inlet port.

BACKGROUND OF THE INVENTION

Desiccant cartridges containing desiccant particles are common in automotive air conditioning systems for dehydrating refrigerants. These desiccant cartridges are adapted to fit within canisters of integrated receiver/dryer (R/D) and accumulator assemblies.

Although various forms of integrated R/D and accumulator assemblies have been suggested in the prior art, the types used in automotive air conditioning systems generally include an elongated canister having inlet and outlet ports communicating with the interior thereof. A desiccant cartridge including a desiccant cup for holding desiccant particles is positioned within the interior of the canister. A desiccant cap is secured to the cup to retain the particles therein.

Typically, the inlet port is centrally located on a lid of the canister thereby allowing a center tube of the inserted desiccant cartridge to easily align and cooperate with the inlet port or a tube extending therefrom. This cooperation allows gas and/or fluid to flow into the canister and through the cartridge enabling the desiccant particles to remove moisture therefrom. More particularly, the gas or fluid enters the canister via the inlet port, travels through the tube extending therefrom, passes through the center tube, empties into the interior of the canister, flows through the desiccant cartridge, and finally exits the canister via the outlet port.

In contrast, some canisters are provided with an inlet port that is offset from the center such that a center tube desiccant cartridge must be accommodated in order to cooperate with the offset port or a side tube extending therefrom. One way to accommodate the combination including an offset inlet port and a desiccant cartridge having a center tube is to bend the side tube such that it connects the center tube of the cartridge with the offset port. However, this option is expensive and somewhat difficult to do.

Alternatively, the desiccant cartridge with center tube can be replaced with a cartridge having a desiccant cup provided with an offset tube for aligning and cooperating with the offset inlet port, or side tube. However, one of the primary difficulties associated with assembling desiccant cartridges adapted to receive a side tube lies in orienting a hole, or aperture, in the desiccant cap to properly receive the offset tube of the desiccant cup. As such, assembly of current side tube receiving desiccant cartridges is inefficiently done by hand or with expensive automated assembly systems.

Accordingly, desiccant cartridges provided with an offset tube typically are more expensive than the standard center tube cartridges.

Notably, the desiccant cartridge of the present invention includes a desiccant cup having a center tube and a desiccant cap adapted to easily cooperate with both the center tube and an offset inlet port, or side tube, of a canister of an integrated receiver/dryer (R/D) or accumulator assembly thereby eliminating any need to properly orientate the cap on the cup and allowing for the use of simple, inexpensive parts and automated equipment for assembly thereof.

SUMMARY OF THE INVENTION

The desiccant cartridge of the present invention includes a desiccant cup extending along an axis and having spaced inner and outer wall portions connected by a transverse portion to define a chamber having an opening. The outer wall portion includes an upper edge and the inner wall portion defines an elongated center tube with opposing first and second openings. The first opening of the center tube is situated intermediate the transverse portion and the upper edge of the outer portion.

A desiccant cap is provided for receipt in the chamber and is secured to the cup to retain desiccant inside the chamber. The cap includes a planar portion having an outer circumference and a recessed port area provided with a first aperture for cooperating with a side tube of a canister. A peripheral flanged portion extends transversely from the outer circumference and cooperates with the outer wall portion of the cup to provide adjustable, friction mount of the cap in the cup. The recessed port area is recessed in a direction substantially parallel with the peripheral flanged portion. The cap may include a first tube having first and second ends with the first end cooperating with the first aperture and the second end extending in a direction away therefrom for cooperating with an offset inlet port, or the side tube, of a canister.

The cap also includes a docking piece provided with a second aperture for cooperating with the center tube of the cup when the cap is retained therein. The docking piece further cooperates with the recessed port area, preferably via a snap fit, to define a passageway therebetween. Preferably, the docking piece is detachably removable. However, the artisan will appreciate that it could be hingedly attached to the lid or secured thereto in any number of ways. The cap further may include a second tube having first and second ends with the first end of the second tube cooperating with the second aperture and the second end of the second tube extending in a direction away therefrom for cooperating with the center tube of the desiccant cup when the cap is retained therein.

Accordingly, the desiccant cartridge of the present invention is designed to be used in combination with a canister of an integrated R/D or accumulator assembly. The canister includes an outer wall axially disposed and has a bottom wall cooperating with the outer wall to define a chamber having an opening. The canister further is provided with a canister lid having an inlet and outlet port therein. The inlet port is offset from the center and, preferably, has a side tube with first and second ends. The first end of the side tube cooperates with the inlet port such that the side tube extends away therefrom into the chamber of the canister. During assembly the lid is secured, preferably by welding, to the canister opposite the bottom wall to seal the chamber.

Prior to placing and welding the top wall onto the canister to complete the integrated RID or accumulator assembly, an assembled desiccant cartridge is placed within the chamber so that the first aperture in the recessed port area of the desiccant cap, or second end of the first tube, cooperates with the side tube when the canister lid is placed thereon. This assembly allows gas and/or fluid to enter the canister via the offset inlet port and travel through the side tube extending therefrom. The gas and/or fluid then travels through the first tube, the first aperture, and the passageway, flows out the second aperture, through the second tube, into and out of the center tube, into the interior of the canister, through the desiccant cartridge, and finally exits the canister via the outlet port. The artisan will appreciate that the direction, or flow, of gas and/or fluid could be reversed such that the offset inlet port becomes an offset outlet port and the outlet port becomes an inlet port.

Accordingly, it is one object of the invention to provide a desiccant cartridge including a desiccant cup having a center tube and a desiccant cap for cooperating with both the center tube of the cartridge and a side tube, or offset inlet port, of a canister Also, it is another object of the invention to eliminate any need to properly orientate the cap on a cup and to allow for the use of simple, inexpensive automated equipment for assembly thereof.

It is another object of the invention to eliminate the need to design and manufacture expensive offset tube desiccant cartridges.

Lastly, it is another object of the invention to eliminate the need to provide expensive bent side tubes for center tube desiccant cartridges used in canisters have offset inlet ports.

The invention will be further described in conjunction with the appended drawings and the following detailed description.

DETAILED DESCRIPTION OF THE PREFERRED EMBODIMENT

FIGS. 1–9 illustrate the desiccant cartridge 10 of the present invention including a desiccant cap 12 adapted for use in a canister 14 of an integrated R/D or accumulator assembly (not shown) having an offset inlet port 16.

Figure 1:
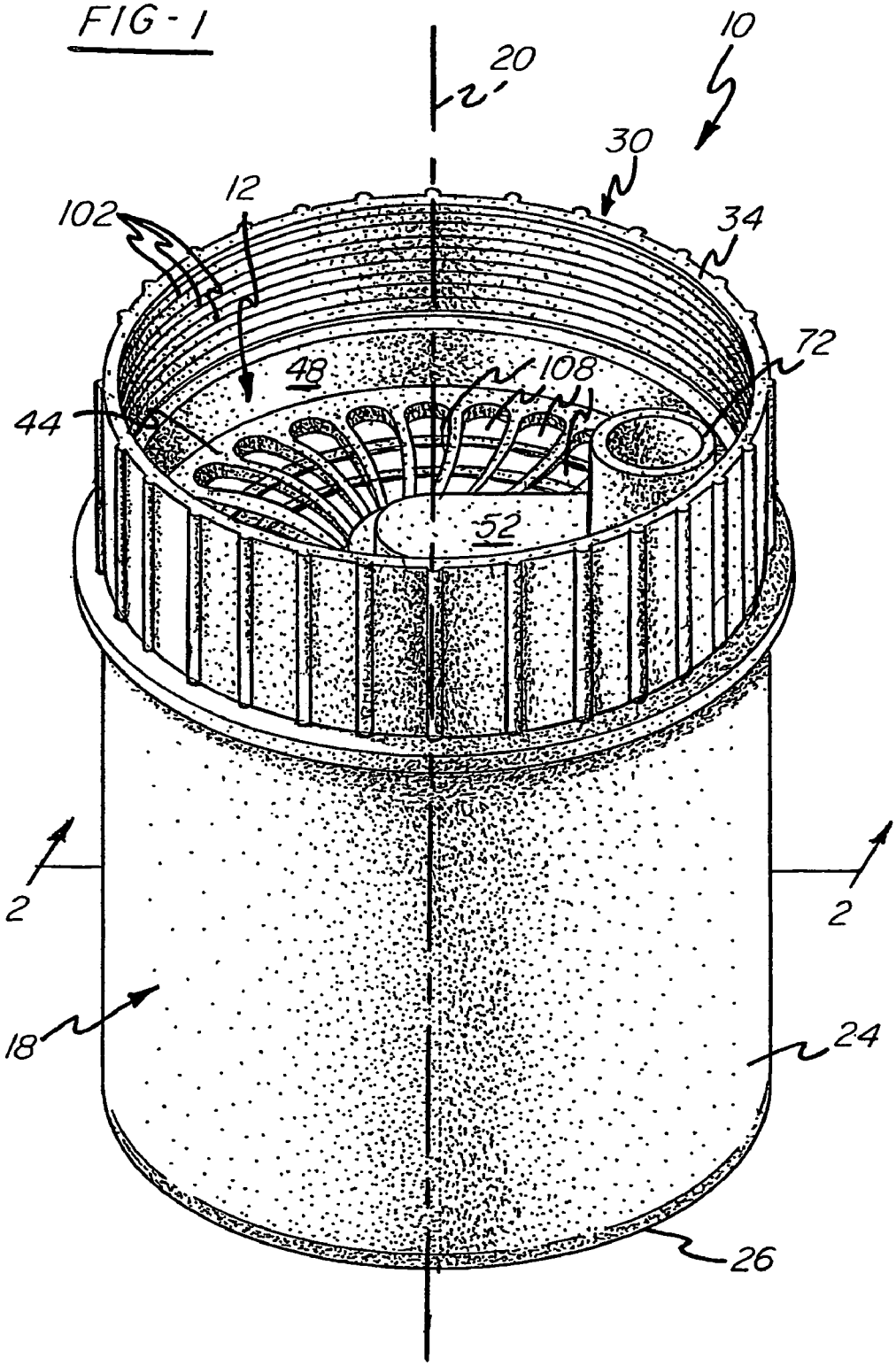
FIG. 1 is a perspective view of the desiccant cartridge of the present invention.
Figure 2:
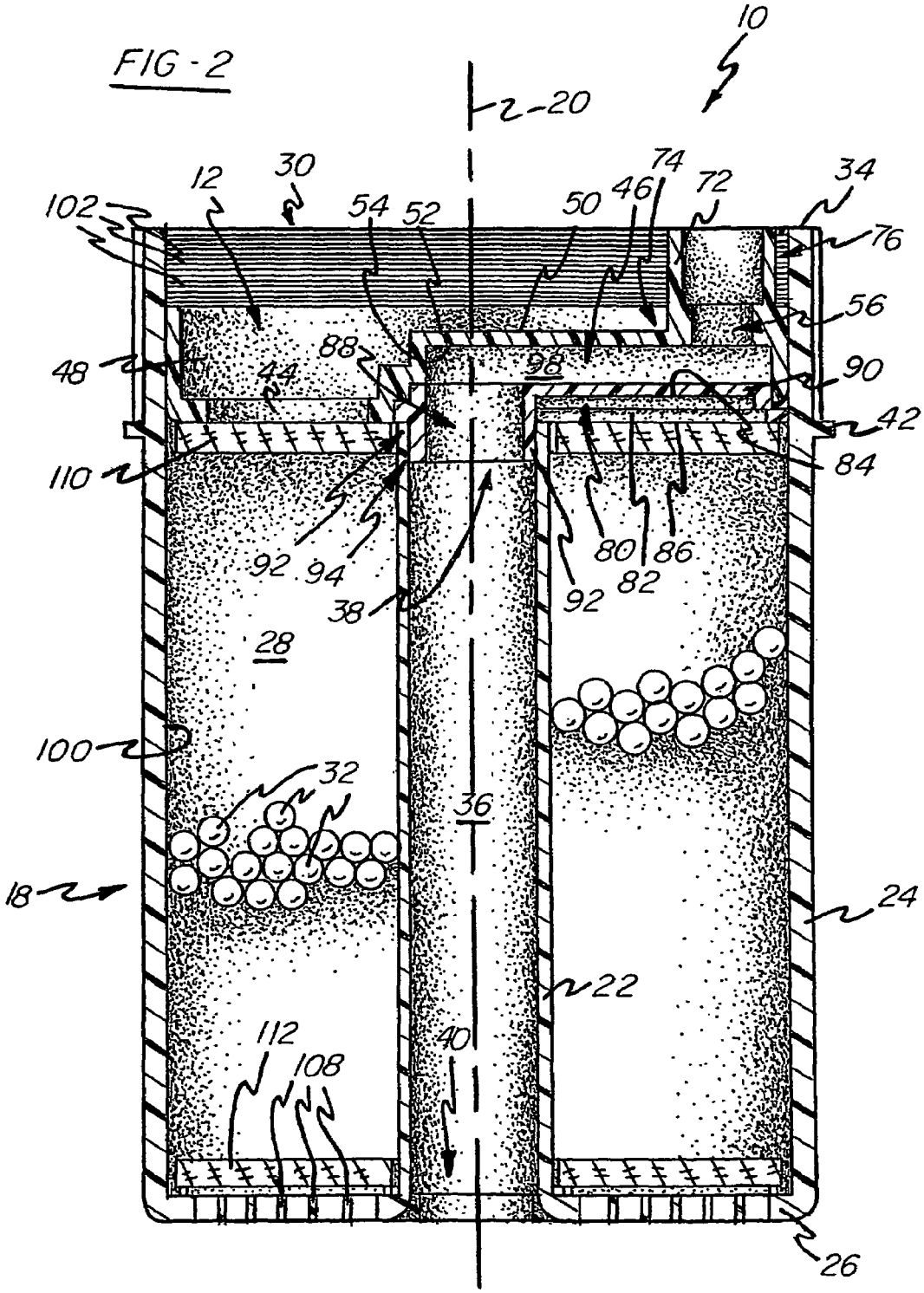
FIG. 2 is a cross-sectional view of the desiccant cartridge of FIG. 1 taken along lines 2—2.

FIGS. 1 and 2 show a desiccant cartridge 10 including a desiccant cup 18 extending along an axis 20 and having spaced inner (FIG. 2) and outer wall portions 22 and 24 connected by a transverse portion 26 to define a chamber 28 having an opening 30 for receiving desiccant particles 32. As best shown in FIG. 2, the outer wall portion 24 includes an upper edge 34 and the inner wall portion 22 defines a center tube 36 having opposing first and second openings 38 and 40 with the first opening 38 situated intermediate the transverse portion 26 and the upper edge 34 of the outer wall portion 24.

The cup 18 preferably is a one-piece plastic molding formed from polypropylene by conventional molding techniques, although polyester may also be mentioned as another polymer that may be used. A leak detection dye (not shown) in the form of a wafer, or the like, may also be placed within the chamber. The dye wafer (not shown) is used to identify leaks in the air conditioning system (not shown).

Figure 9:
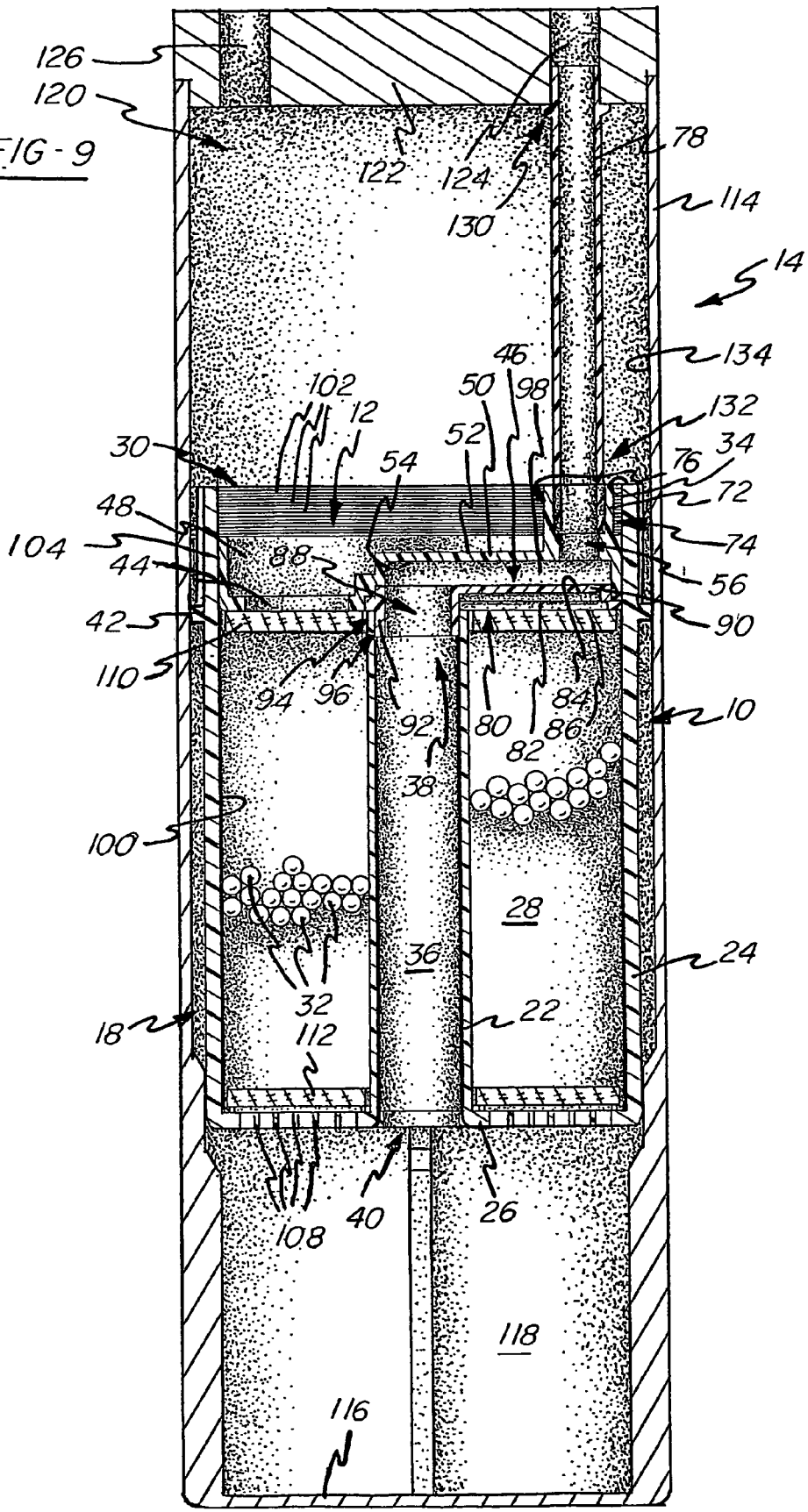
FIG. 9 is a cross-sectional view of the desiccant cartridge of FIG. 1 installed in a canister of an integrated R/D or accumulator assembly.

As shown in FIG. 2, the cup 18 further is provided with a continuous flange 42 made of polypropylene plastic or a thermoplastic elastomer. The flange 42 extends outwardly from the outer wall portion 24 and is located intermediate the transverse portion 26 and the upper edge 34 of the outer wall portion 24 to help retain the desiccant cartridge 10 within the canister 14 by means of a friction or interference fit. The flange 42 also serves as a continuous annular seal to prevent gas and/or fluid escape that may otherwise occur along the interface between the circumference of the cup 18 and the canister 14 (FIG. 9).

Figure 3:
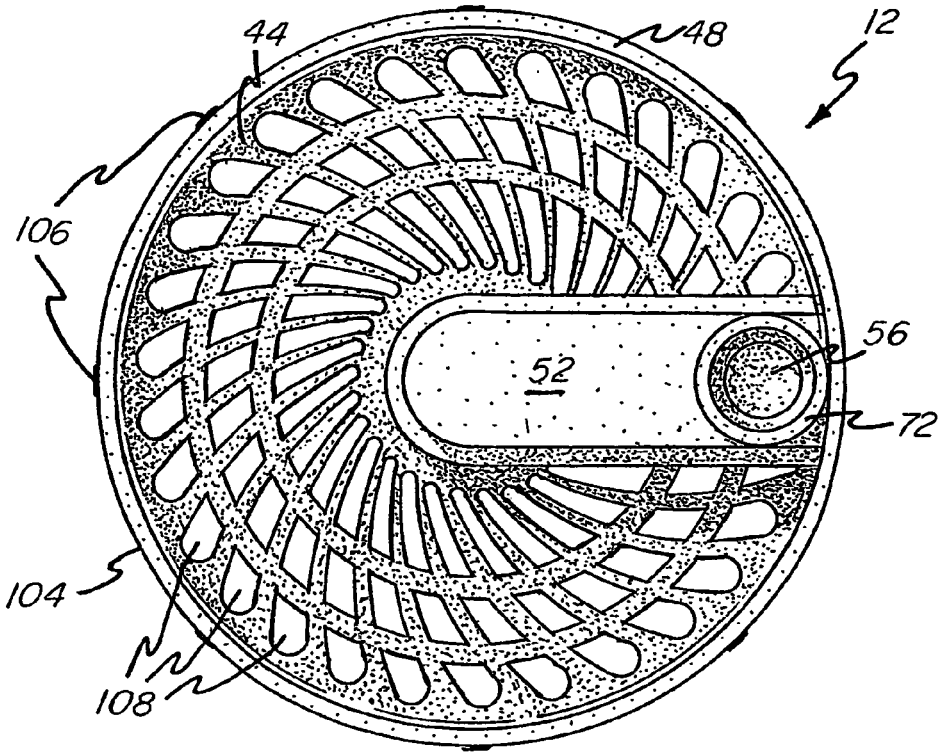
FIG. 3 is a top plan view of the desiccant cap of the present invention.
Figure 4:
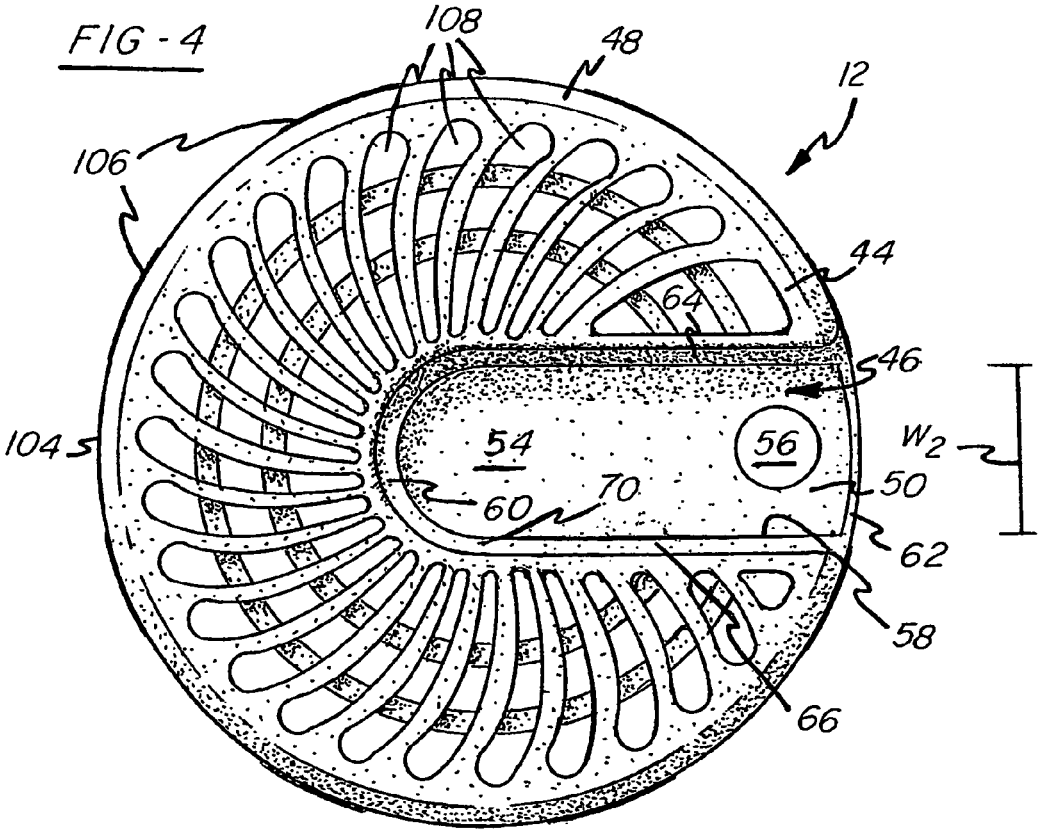
FIG. 4 is a bottom plan view of the desiccant cap of FIG. 3 with the docking piece removed therefrom.

FIGS. 1 and 2 further show a desiccant cap 12 provided for receipt in the chamber 28 (FIG. 2) of the cup 18 and secured thereto to retain desiccant therein. As best shown in FIGS. 3 and 4, the cap 12 includes a planar portion 44 having an outer circumference and a recessed port area 46 (FIG. 4). A peripheral flanged portion 48, best illustrated in FIG. 7, extends transversely from the outer circumference. FIG. 1 shows the peripheral flanged portion 48 cooperating with the outer wall portion 24 of the cup 18 to provide adjustable, friction mount of the cap 12 in the cup 18.

Figure 8:
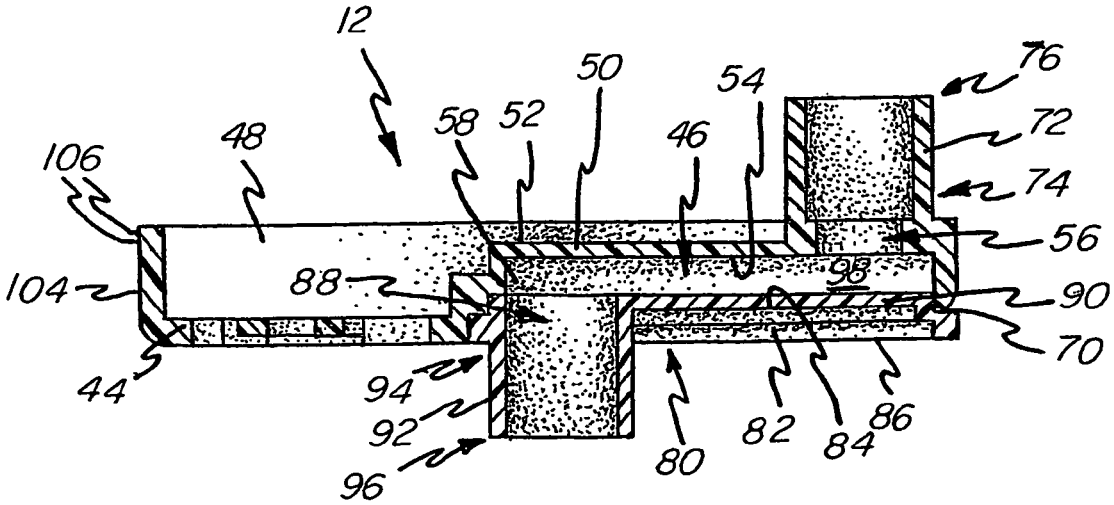
FIG. 8 is a cross-sectional view of the desiccant cap of FIG. 7 taken along lines 8—8.

As best shown in FIGS. 4 and 8, the recessed port area 46 is recessed in a direction substantially parallel with the peripheral flanged portion 48. In FIG. 4, the recessed port area 46 is defined by a bottom portion 50 having a top (FIG. 8) and bottom surface 52 and 54 and a first aperture 56 extending therethrough. A wall 58 encircles the bottom portion 50 and includes opposing first and second end walls 60 and 62 and opposing first and second side walls 64 and 66. Each of the side 64, 66 and end walls 60, 62 have a top surface 68 cooperating to define a ledge 70. The ledge 70 substantially cooperates with the planar portion 44 such that the recessed port area 46 is set into the planar portion 44. Preferably, the first aperture 56 is located proximate the peripheral flanged portion 48. Also, as shown in FIG. 8, the top surface 52 of the recessed port area 46 preferably is provided with a first tube 72 having first and second ends 74 and 76 with the first end 74 cooperating with the first aperture 56 and the second end 76 extending in a direction away from the top surface 52 for cooperating with a side tube 78 (FIG. 9) of a canister 14 (FIG. 9).

Figure 5:
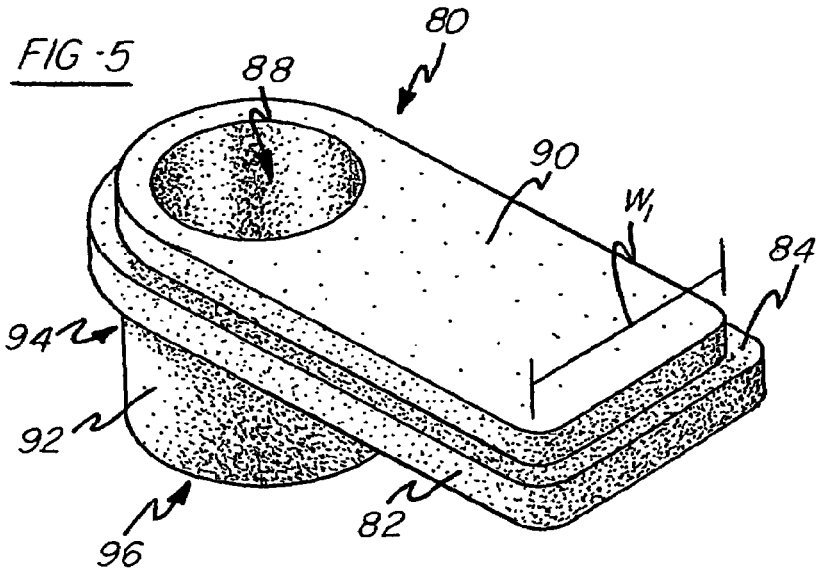
FIG. 5 is a perspective view of the docking piece of the present invention.
Figure 6:
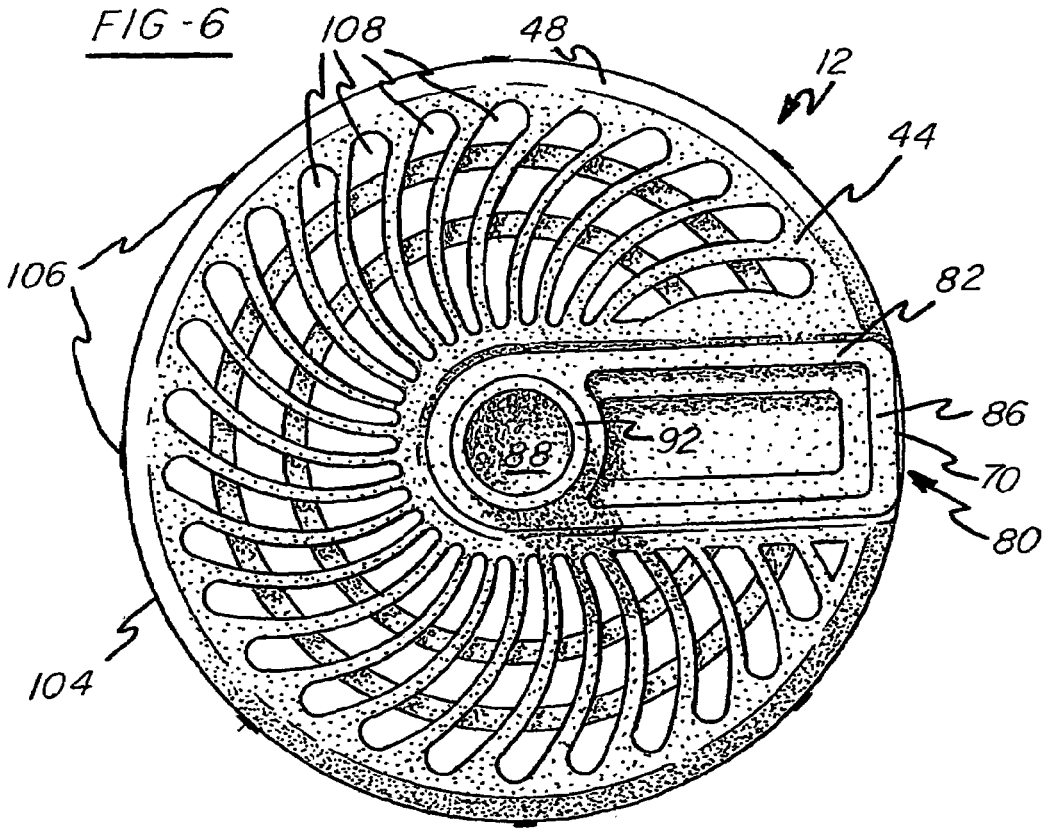
FIG. 6 is a bottom plan view of the desiccant cap of FIG. 3 with the docking piece of FIG. 5 cooperating therewith.

In FIGS. 5 and 6, a docking piece 80 is shown for cooperating with the recessed port area 46 (FIG. 3) of the cap 12. The docking piece 80 has a body 82 with a top (FIG. 5) and bottom surface (FIG. 6) 84 and 86 and a second aperture 88 extending therethrough. The top surface 84 of the body 82 is substantially provided with a raised portion 90 protruding therefrom with the second aperture 88 extending therethrough. The bottom surface 86 (FIG. 6) of the body 82 preferably includes a second tube 92 having first and second ends (FIG. 5) 94 and 96 with the first end (FIG. 5) 94 of the second tube 92 cooperating with the second aperture 88. The second end (FIG. 5) 94 of the second tube 92 extends in a direction away from the bottom surface 86 (FIG. 6) of the body 82 for cooperating with the center tube 36.

As best shown in FIG. 8, the docking piece 80 cooperates with the recessed port area 46 such that the top surface 84 of the body 82 cooperates with the ledge 70 and the raised portion 90 is received within the recessed port area 46 and further bounded by the wall 58 to define a passageway 98. Notably, the raised portion 90 has a first width $W_1$ (FIG. 5) thereacross and the opposing first and second side walls 64, 66 define a second width $W_2$ (FIG. 4). The first width $W_1$ (FIG. 5) is greater than the second width $W_2$ (FIG. 4) thereby creating a snap fit for the docking piece 80 within the recessed port area 46. During cooperation of the docking piece 80 with the recessed port area 46, the second aperture 88 preferably is centrally located on the cap 12. While it is preferred that the docking piece 80 be detachably removable, the artisan will appreciate that the docking piece 80 could be hingedly attached to the cap 12 or secured thereto in any number of ways.

Figure 7:
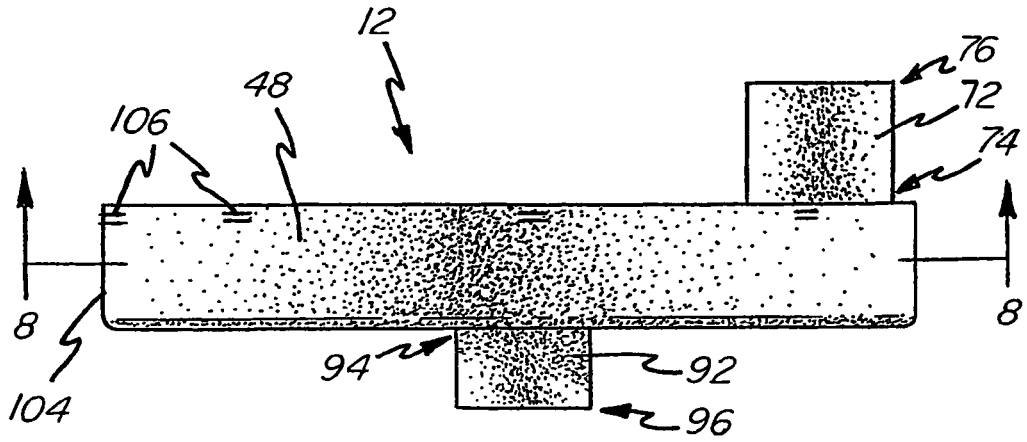
FIG. 7 is a side elevation view of the desiccant cap of FIG. 6.

As shown in FIGS. 1 and 2, an inner surface 100 (FIG. 2) of the outer wall portion 24 of the cup 18 may include a plurality of inner surface protrusions 102 including, but not limited to, ribs, nibs, beads, bumps or other equivalent protrusions projecting radially inwardly from the outer wall portion 24 which engage and retain the cap 12 in one of a number of axially spaced positions. Additionally, as best shown in FIG. 7, an outer surface 104 of the peripheral flanged portion 48 may further be provided with complimentary surface protrusions 106 for cooperating with the inner surface protrusions 102 (FIG. 2) of the inner surface 100 (FIG. 2) of the outer wall portion 24 (FIG. 2) to retain the cap 12 more securely within the cup 18 (FIG. 2).

As further shown in FIGS. 1 and 2, the transverse portion 26 of the cup 18 and the planar portion 44 of the cap 12 are each perforated with a number of ports 108 or perforations so that the planar portion 44 and the transverse portion 26 are each permeable to the gas and/or fluid (not shown) to be dried. As best shown in FIG. 3, the planar portion 44 is substantially provided with a multiplicity of oblong, petal shaped ports 108 generally disposed with their major axes radially extending from the center tube 36 toward the circumference of the cap 12. The ports 108 of the cap 12 and transverse portion 26 (FIG. 2) preferably are arranged in one concentric annular row. The precise arrangement and shapes of the ports 108 is not critical to the operation of the desiccant cartridge 10 (FIG. 2) as long as the desiccant 32 (FIG. 2) remains contained and gas and/or fluid (not shown) is allowed to enter the cartridge 10 (FIG. 2), interact evenly with the desiccant 32 (FIG. 2), and exit from the cartridge 10 (FIG. 2).

As shown in FIG. 2, plies 110 and 112 of a permeable lining material, such as felted polyester or gauze can be placed inside the chamber 28 near the transverse portion 26 and the cap 12 to trap the desiccant 32 in the cartridge 10. The plies 110, 112 must be permeable to the gas and/or fluid (not shown) to be dried but impermeable to the particulate desiccant 32.

Accordingly, as shown in FIG. 9, the desiccant cartridge 10 of the present invention is designed to be used in combination with a canister 14 of an integrated R/D or accumulator assembly (not shown). The canister 14 includes an outer wall 114 axially disposed and has a bottom wall 116 cooperating with the outer wall 114 to define a chamber 118 having an opening 120. The canister 14 further is provided with a canister lid 122 having an inlet and outlet port 124 and 126 therein. The inlet port 124 is offset from the center of the lid 122 and, preferably, has a side tube 78 with first and second ends 130 and 132. The first end 130 of the side tube 78 cooperates with the offset inlet port 124 such that the side tube 78 extends away therefrom into the chamber 118 of the canister 14. During assembly the lid 122 is secured, preferably by welding, to the canister 14 opposite the bottom wall 116 to seal the chamber 118.

Prior to placing and welding the lid 122 onto the canister 14 to complete the integrated R/D or accumulator assembly (not shown), a desiccant cartridge 10 is assembled. To assemble the desiccant cartridge 10, a first ply 110 of permeable lining material is inserted by sliding it down the inner wall portion 22 until positioned adjacent the transverse portion 26. Then, the required amount of desiccant 32 is poured therein. The desiccant material 32 comprises beads that are commercially available from Universal Oil Products under the XH7 designation. A dye wafer (not shown) also may be placed into the chamber 28. Once the desiccant 32 is charged, the second ply 112 of the permeable lining material can be slid down the inner wall portion 22 against the desiccant 32. The cap 12 is then inserted into the chamber 28 and urged downwardly toward the transverse portion 26 until the cap 12 abuts against the center tube 36.

Once the desiccant cartridge 10 is assembled, it is inserted into a canister 14 as shown in FIG. 9. The cartridge 10 may be vibrator or bowl fed to a robotic arm (not shown) for automatic installation into the canister 14. The continuous flange 42 cooperates with an inner surface 134 of the canister 14 thereby forming a proper seal therebetween. When the lid 122 is placed onto the canister 14, the side tube 78 aligns with the first tube 72 so that the offset inlet port 124 and center tube 36 of the desiccant cartridge 10 are in communication. This assembly allows the gas and/or fluid (not shown) to enter the canister 14 via the offset inlet port 124 and travel through the side tube 78 extending therefrom. The gas and/or fluid (not shown) then travels through the first tube 72, the first aperture 56, and the passageway 98, flows out the second aperture 88, through the second tube 92, into and out of the center tube 36, into the chamber 118 of the canister 14, through the ports 108 in the desiccant cartridge 10, and finally exits the canister 14 via the outlet port 126. The artisan will appreciate that the direction, or flow, of gas and/or fluid could be reversed such that the offset inlet port becomes an offset outlet port and the outlet port becomes an inlet port.

Accordingly, the desiccant cartridge 10 of the present invention easily cooperates with both the center tube 36 and the offset inlet port 124, or side tube 78, of the canister 14 thereby eliminating any need to properly orientate the cap 12 on the cup 18 and allowing for the use of simple, inexpensive parts and automated equipment for assembly thereof.

Various changes or modifications in the invention described may occur to those skilled in the art without departing from the true spirit or scope of the invention. The above description of preferred embodiments of the invention is intended to be illustrative and not limiting, and it is not intended that the invention be restricted thereto but that it be limited only by the true spirit and scope of the appended claims.

What is claimed is:

1. In a desiccant cartridge, a combination comprising a generally circular cap for providing closure over said desiccant cartridge to retain desiccant therein and a docking piece for engagement with said cap, said combination having a central axis extending therethrough and a first aperture coaxial with said central axis for communication with said desiccant cartridge, said cap having a recess in the form of a port formed along a surface of said cap and extending radially outwardly along said surface from said central axis, said docking piece being detachably engaged in said port, said combination further comprising a second aperture therein radially spaced from said first aperture so as to be offset from the central axis and in communication with said first aperture through a passageway formed by the cap and the docking piece.

2. Combination as set forth in claim 1 wherein said housing is snap fit within said port.

3. Combination as set forth in claim 1 wherein the cap comprises a peripheral flanged portion extending transversely from its outer circumference that cooperates with a cup of the desiccant cartridge to provide adjustable, friction mount of the cap in the cup and wherein the second aperture is located proximate the peripheral flanged portion.

4. A desiccant cartridge comprising:

a cup having a spaced inner and outer wall portion to define a chamber for holding desiccant, said inner wall portion defining a center tube;

a cap for providing closure over said desiccant cartridge to retain said desiccant therein, said cap having a recess in the form of a port formed in a surface of said cap and extending radially outwardly along said surface from a central axis of said cartridge; and a docking piece engaged with said cap in said port, wherein the combination of said cap and docking piece has a first aperture coaxial with said central axis for communication with said desiccant in said cup, said combination further comprising a second aperture therein radially spaced from said first aperture so as to be offset from the central axis and in communication with said first aperture through a passageway formed by the cap and the docking piece.

5. The desiccant cartridge of claim 4 wherein the cup is a one-piece plastic molding.

6. The desiccant cartridge of claim 4 wherein the cap comprises a peripheral flanged portion extending transversely from its outer circumference that cooperates with the outer wall portion of the cup to provide adjustable, friction mount of the cap in the cup.

7. The desiccant cartridge of claim 6 wherein the second aperture is located proximate the peripheral flanged portion.

8. The desiccant cartridge of claim 6 wherein a top surface of the cap is provided with a tube having first and second ends, with the first end cooperating with the second, offset aperture and the second end extending in a direction away from the top surface for cooperating with a side tube of a canister.

9. The desiccant cartridge of claim 6 wherein the docking piece has a body with a top and bottom surface with said first aperture extending therethrough, wherein the top surface is provided with a raised portion protruding therefrom and the bottom surface is provided with a second tube having first and second ends, with the first end of the second tube cooperating with the first aperture and the second end of the second tube extending in a direction away from the bottom surface for cooperating with the center tube of the cup.

10. The desiccant cartridge of claim 9 wherein the raised portion cooperates with the cap to form said passageway.

11. In a desiccant cartridge, a combination comprising a generally circular cap for providing closure over said desiccant cartridge to retain desiccant therein and a docking piece for engagement with said cap, said cap comprising a planar portion having a recessed port extending from a center axis of the cap radially outward and provided with an aperture through said cap offset from the center axis of said cap, and the docking piece detachably engaged in said recessed port provided with a central aperture coaxial with the central axis for communicating fluid and/or gas with said desiccant in the desiccant cartridge, said docking piece being engaged in said recessed port area and defining a passageway therebetween so that fluid and/or gas entering said offset aperture passes through said passageway and said central aperture into the desiccant cartridge.

12. The desiccant cartridge of claim 11 further comprising a cup having a spaced inner and outer wall portion to define a chamber for holding desiccant, said inner wall portion defining a center tube.

13. The desiccant cartridge of claim 12 wherein the cap comprises a peripheral flanged portion extending transversely from its outer circumference that cooperates with the outer wall portion of the cup to provide adjustable, friction mount of the cap in the cup.

14. The desiccant cartridge of claim 13 wherein the second aperture is located proximate the peripheral flanged portion.

15. The desiccant cartridge of claim 11 wherein a top surface of the cap is provided with a tube having first and second ends, with the first end cooperating with the second, offset aperture and the second end extending in a direction away from the top surface for cooperating with a side tube of a canister.

16. The desiccant cartridge of claim 15 wherein the docking piece has a body with a top and bottom surface with said first, central aperture extending therethrough, wherein the top surface is provided with a raised portion protruding therefrom and the bottom surface is provided with a second tube having first and second ends, with the first end of the second tube cooperating with the central aperture and the second end of the second tube extending in a direction away from the bottom surface for cooperating with a center tube of the cup.

17. The desiccant cartridge of claim 16 wherein the raised portion cooperates with the cap to form said passageway.

* * * * *